US010689586B2

(12) United States Patent
Dongara et al.

(10) Patent No.: US 10,689,586 B2
(45) Date of Patent: Jun. 23, 2020

(54) METHODS AND SYSTEMS FOR PRODUCING OLEFINS AND AROMATICS FROM COKER NAPHTHA

(71) Applicant: SABIC Global Technologies B.V., Bergen op Zoom (NL)

(72) Inventors: Rajeshwer Dongara, Bangalore (IN); Pankaj Mathure, Bangalore (IN); Mohammad Basheer Ahmed, Bangalore (IN); Venugopal Bv, Bangalore (IN)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 35 days.

(21) Appl. No.: 16/061,954

(22) PCT Filed: Dec. 13, 2016

(86) PCT No.: PCT/IB2016/057580

§ 371 (c)(1),
(2) Date: Jun. 13, 2018

(87) PCT Pub. No.: WO2017/109639

PCT Pub. Date: Jun. 29, 2017

(65) Prior Publication Data

US 2018/0371337 A1 Dec. 27, 2018

Related U.S. Application Data

(60) Provisional application No. 62/270,160, filed on Dec. 21, 2015.

(51) Int. Cl.
*C10G 67/02* (2006.01)
*C10G 69/04* (2006.01)
(Continued)

(52) U.S. Cl.
CPC ..... *C10G 67/02* (2013.01); *C10G 11/02* (2013.01); *C10G 25/00* (2013.01); *C10G 31/09* (2013.01);
(Continued)

(58) Field of Classification Search
CPC ..... C10G 57/005; C10G 63/04; C10G 67/04; C10G 69/04; C10G 69/123;
(Continued)

(56) References Cited

U.S. PATENT DOCUMENTS 2,739,993 A 3/1956 Abraham et al. ..... 260/667
3,390,200 A 6/1968 Sze ..... 260/672
(Continued)

FOREIGN PATENT DOCUMENTS

CA 2219137 10/1996
CN 103328416 A 9/2013
(Continued)

OTHER PUBLICATIONS

International Search Report and Written Opinion from PCT/IB2016/057580, dated Mar. 17, 2017, 12 pages.
(Continued)

*Primary Examiner* — Renee Robinson
(74) *Attorney, Agent, or Firm* — Norton Rose Fulbright US LLP

(57) ABSTRACT

Methods and systems for producing olefins and aromatics are provided. Methods can include removing silica from the coker naphtha feedstock to produce a first effluent, hydrogenating the first effluent to produce a second effluent, reacting the second effluent to produce a third effluent comprising aromatics, a fourth effluent comprising olefins, and a fifth effluent, separating the fourth effluent to produce
(Continued)

a propylene product stream, an ethylene product stream, and a sixth effluent, recycling the sixth effluent by combining it with the second effluent.

15 Claims, 2 Drawing Sheets

(51) Int. Cl.

| | |
|---|---|
| ***C10G 69/12*** | (2006.01) |
| ***C10G 67/06*** | (2006.01) |
| ***C10G 45/32*** | (2006.01) |
| ***C10G 31/09*** | (2006.01) |
| ***C10G 25/00*** | (2006.01) |
| ***C10G 57/00*** | (2006.01) |
| ***C10G 67/04*** | (2006.01) |
| ***C10G 11/02*** | (2006.01) |
| ***C10G 35/06*** | (2006.01) |
| ***C10G 45/08*** | (2006.01) |
| ***C10G 55/02*** | (2006.01) |

(52) U.S. Cl.
CPC ..... *C10G 35/06* (2013.01); *C10G 45/08* (2013.01); *C10G 45/32* (2013.01); *C10G 55/02* (2013.01); *C10G 57/005* (2013.01); *C10G 67/04* (2013.01); *C10G 67/06* (2013.01); *C10G 69/04* (2013.01); *C10G 69/123* (2013.01); *C10G 2300/1044* (2013.01); *C10G 2300/4081* (2013.01); *C10G 2400/20* (2013.01); *C10G 2400/22* (2013.01); *C10G 2400/30* (2013.01)

(58) Field of Classification Search
CPC ..... C10G 2300/1044; C10G 2400/20; C10G 2400/22; C10G 2400/30
See application file for complete search history.

(56) References Cited

U.S. PATENT DOCUMENTS

| | | | | |
|---|---|---|---|---|
| 3,556,987 | A | 1/1971 | Zimmerman et al. | 208/93 |
| 3,617,495 | A | 11/1971 | Zimmerman, Jr. et al. | 208/80 |
| 4,138,325 | A | 2/1979 | Beuther et al. | 208/50 |
| 4,176,047 | A | 11/1979 | Orrell et al. | 208/51 |
| 4,179,474 | A | 12/1979 | Beuther et al. | 585/251 |
| 4,404,092 | A | 9/1983 | Audeh et al. | 208/131 |
| 4,463,206 | A | 7/1984 | Derrien et al. | 585/483 |
| 4,645,587 | A | 2/1987 | Kokayeff | 208/91 |
| 4,661,241 | A | 4/1987 | Dabkowski et al. | 208/131 |
| 4,853,106 | A | 8/1989 | Grove et al. | 208/131 |
| 5,043,522 | A | 8/1991 | Leyshon et al. | 585/651 |
| 5,069,776 | A | 12/1991 | Biswas et al. | 208/120.1 |
| 5,200,061 | A | 4/1993 | Viscontini | 208/131 |
| 5,225,072 | A | 7/1993 | Vidueira | 208/313 |
| 5,258,115 | A | 11/1993 | Heck et al. | 208/131 |
| 5,292,976 | A | 3/1994 | Dessau et al. | 585/322 |
| 5,399,244 | A | 3/1995 | Gentry et al. | 203/23 |
| 5,685,972 | A | 11/1997 | Timken et al. | 208/89 |
| 5,723,026 | A | 3/1998 | Leisse et al. | 203/58 |
| 6,153,089 | A | 11/2000 | Das et al. | 208/134 |
| 6,565,742 | B1 | 5/2003 | Gentry et al. | 208/311 |
| 7,128,827 | B2 | 10/2006 | Tallman et al. | 208/78 |
| 7,563,358 | B2 | 7/2009 | Stavens et al. | 208/138 |
| 2003/0181325 | A1 | 9/2003 | Ou et al. | 502/302 |
| 2005/0014639 | A1 | 1/2005 | Bhan et al. | 502/313 |
| 2008/0156696 | A1 | 7/2008 | Niccum et al. | 208/78 |
| 2008/0194900 | A1 | 8/2008 | Bhirud | 585/648 |
| 2012/0273394 | A1 | 11/2012 | Banerjee et al. | 208/264 |
| 2013/0245351 | A1 | 9/2013 | Al-Haji | 585/805 |
| 2013/0253242 | A1* | 9/2013 | Kim | C07C 4/06 585/323 |

FOREIGN PATENT DOCUMENTS

| | | | |
|---|---|---|---|
| CN | 103374395 | A | 10/2013 |
| CN | 102795958 | B | 3/2015 |
| EP | 0385538 | A1 | 9/1990 |
| EP | 0490435 | B1 | 8/1994 |
| EP | 0372632 | B1 | 1/1996 |
| EP | 1188811 | A1 | 3/2002 |
| EP | 1734098 | A1 | 12/2006 |
| EP | 2644584 | A1 | 10/2013 |
| WO | WO2006088539 | | 8/2006 |
| WO | WO2012070706 | | 5/2012 |
| WO | WO2015000846 | | 1/2015 |

OTHER PUBLICATIONS

Lengyel et al. "Upgrading of Delayed Coker Light Naphtha in a Crude Oil Refinery." Petroleum & Coal 51 (2) 80-90, 2009.
Nizamoff, Alan J. "On-Purpose Butadiene." PERP 2012S3, Nexant, Mar. 2013, 7 pages, Report Abstract.
Nizamoff, Alan J. "Benzene/Toluene." PERP 2011-1, Nexant, Oct. 2011, 7 pages, Report Abstract.
Breivik et al. "Coker naphtha hydrotreating." Petroleum Technology Quarterly, Q1 2008, www.digitalrefining.com/article/1000153, 7 pages.

* cited by examiner

METHODS AND SYSTEMS FOR PRODUCING OLEFINS AND AROMATICS FROM COKER NAPHTHA

CROSS-REFERENCE TO RELATED APPLICATIONS

This application is a national phase application under 35 U.S.C. § 371 of International Application No. PCT/IB2016/057580 filed Dec. 13, 2016, which claims priority to U.S. Provisional Patent Application No. 62/270,160 filed Dec. 21, 2015. The entire contents of each of the above-referenced disclosures is specifically incorporated by reference herein without disclaimer.

FIELD

The disclosed subject matter relates to methods and systems for producing olefins and aromatics from coker naphtha.

BACKGROUND

Because of a growing demand for petrochemicals, including olefins and aromatics, there is interest in the conversion of alternative feedstocks into useful petrochemicals. One alternative feedstock is coker naphtha, which can be a hydrocarbon stream produced by the thermal cracking of long chain hydrocarbons in a coker unit. During oil refinery processing, the coker unit converts residual oil from a distillation column into shorter chain hydrocarbons, including low molecular weight hydrocarbon gases and naphtha. Coker naphtha can contain unsaturated hydrocarbons such as olefins, diolefins and aromatics, as well as sulfur, silica, and nitrogen. Diolefins, sulfur, and silica in the coker naphtha stream can cause reactor fouling and complicate the production of high value olefins and aromatics.

Certain methods for generating potentially higher value petrochemicals from a hydrocarbon stream are known in the art. For example, European Patent Publication No. EP2644584 discloses methods of producing aromatics and olefins from a refinery fraction containing aromatics, including a hydrogen-processing reaction step, a catalytic cracking step, a separation step, and a transalkylation step, and optionally a recirculation step. Chinese Patent Publication No. CN102795958 discloses techniques for generating aromatics and ethylene from naphtha, by the reforming of naphtha to produce aromatics and alkanes and the steam cracking of produced alkanes. U.S. Pat. No. 4,179,474 discloses a method of pyrolyzing naphtha to produce ethylene, including blending a catalytically hydrogenated naphtha stream with a sulfur containing compound. U.S. Pat. No. 4,138,325 discloses a process for the conversion of gas oil to a naphtha pyrolysis feedstock and needle coke, including thermally cracking gas oil to produce cracked naphtha and aromatic tar oil.

U.S. Pat. No. 6,153,089 discloses methods of converting an olefinic hydrocarbon stream to light olefins and aromatics using a dehydrogenated metal catalyst. U.S. Patent Publication No. 2003/0181325 discloses a catalyst including an acid component and at least one metal component for converting paraffins to light olefins. European Patent Publication No. EP1734098 discloses a process for generating olefins and aromatics by the catalytic cracking of naphtha. U.S. Pat. No. 3,556,987 discloses producing acetylene, ethylene, and aromatics from crude oil by distilling crude oil to form multiple streams, including coker naphtha, heavy naphtha, and light naphtha. Coker naphtha and heavy naphtha are combined and reformed to produce a reformed product, including aromatics, and a raffinate, which is fed to a hydrocarbon pyrolysis furnace with the light naphtha to produce ethylene.

However, there remains a need for techniques of producing olefins and aromatics from a coker naphtha stream.

SUMMARY OF THE DISCLOSED SUBJECT MATTER

The disclosed subject matter provides methods and systems for producing olefins and/or aromatics from coker naphtha.

In certain embodiments, an exemplary method of producing olefins and/or aromatics from a coker naphtha feedstock includes removing silica from the coker naphtha feedstock, e.g., in a silica removal unit, to produce a first effluent. The first effluent can be hydrogenated with hydrogen to produce a second effluent. The second effluent can be reacted to produce, e.g., third, fourth, and fifth effluents, where the fourth effluent is separated into a propylene product stream, an ethylene product stream, and a sixth effluent. The sixth effluent can be recycled by combining it with the second effluent.

In certain embodiments, the silica can be removed from the coker naphtha feedstock by one or more of adsorption, filtration, or membrane separation. A catalyst can be used to assist such removal, including alumina, activated alumina, spent alumina-based desulfurizer, and/or spent alumina-supported cobalt-molybdenum oxide catalysts.

In certain embodiments, the first effluent can include silica-free coker naphtha. The second effluent can include paraffins, olefins, naphthenes, and aromatics. The third effluent can include benzene, toluene, xylene, and $C_9$+ aromatics. The fourth effluent can include propylene, ethylene, and propane. The fifth effluent can include butane, fuel gas, and liquefied petroleum gas. The sixth effluent can include butane, liquefied petroleum gas, and propane.

In certain embodiments, benzene, toluene, and xylene can be extracted from the third effluent to produce a benzene product stream, a mixed-xylene product stream, a $C_9$+ aromatics product stream, and a seventh effluent including toluene, olefins, and naphthenes.

In certain embodiments, the method can further include converting toluene in the seventh effluent in the presence of a hydrogen feed to produce an eighth effluent and a ninth effluent. The eighth effluent can include benzene, xylene, and toluene. The ninth effluent can include naphthenes, olefins, liquefied petroleum gas, and propane. The eighth effluent can be recycled by combining it with the third effluent. The ninth effluent can be recycled by combining it with the sixth effluent.

The presently disclosed subject matter also provides systems for producing olefins and aromatics from coker naphtha. The system can include a silica removal unit to remove silica from a coker naphtha feedstock, a hydrogenation unit coupled to the silica removal unit to remove diolefins, acetylene, and sulfur, an olefins and aromatics conversion unit coupled to the hydrogenation unit for conversion to olefins and aromatics, and an olefins separation unit coupled to the olefins and aromatics conversion unit for separating propylene and ethylene. The hydrogenation unit can include a cobalt-molybdenum catalyst. The olefins separation unit can include a fluidized bed, fixed bed, or moving bed reactor.

In certain embodiments, the system can further include a benzene, toluene, and xylene extraction unit coupled to the olefins and aromatics conversion unit for separating benzene, toluene, and xylene, and a toluene conversion unit coupled to the benzene, toluene, and xylene extraction unit for converting toluene to other aromatics. The toluene conversion unit can include a hydrodealkylation unit.

DETAILED DESCRIPTION

The presently disclosed subject matter provides methods and systems for producing olefins and aromatics from coker naphtha.

Figure 1:
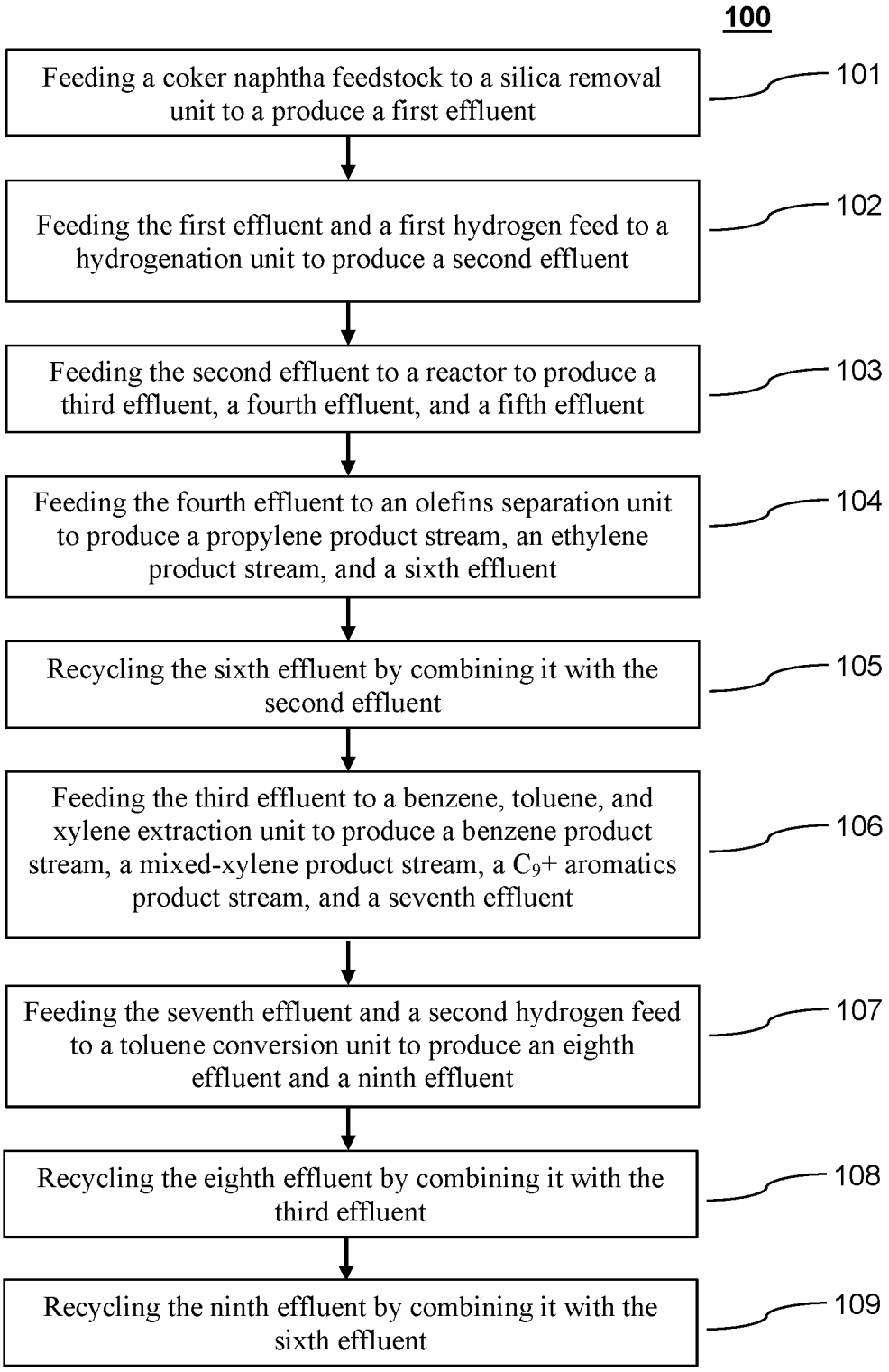
FIG. 1 depicts a method for producing olefins and aromatics from coker naphtha according to one exemplary embodiment of the disclosed subject matter.

The presently disclosed subject matter provides methods for producing olefins, e.g., propylene and ethylene, and aromatics, e.g., benzene, toluene, and xylene, from coker naphtha. For the purpose of illustration and not limitation, FIG. 1 is a schematic representation of a method according to a non-limiting embodiment of the disclosed subject matter.

In certain embodiments, the method 100 includes feeding a coker naphtha feedstock to a silica removal unit to produce a first effluent 101. The coker naphtha feedstock of the presently disclosed subject matter can be a hydrocarbon stream that is rich in olefins and paraffins. The coker naphtha feedstock can be sourced from natural gas condensates, petroleum distillates, coal tar distillates and/or peat. For example, the coker naphtha feedstock can include light naphtha, heavy naphtha, straight run naphtha, full range naphtha, delayed coker naphtha, fluid catalytic cracking (FCC) naphtha, coker fuel oil and/or gas oils, e.g., light coker gas oil and heavy coker gas oil.

In certain embodiments, the coker naphtha feedstock can contain from about 10 wt-% to about 80 wt-% olefins and from about 20 wt-% to about 80 wt-% paraffins. The coker naphtha feedstock can contain from about 10 vol-% to about 65 vol-% olefins and from about 30 vol-% to about 80 vol-% paraffins. The coker naphtha feedstock can further include one or more other components, including, but not limited to, diolefins, naphthenes, aromatics, sulfur, nitrogen, and silica. For example, the coker naphtha feedstock can contain less than about 1 wt-% diolefins, less than about 1 wt-% naphthenes, less than about 1 wt-% aromatics and less than about 0.1 wt-% sulfur. The coker naphtha feedstock can contain from about 0.1 vol-% to about 8 vol-% diolefins, from about 2 vol-% to about 25 vol-% naphthenes, from about 0.1 vol-% to about 25 vol-% aromatics and from about 0.01 vol-% to about 5 vol-% sulfur. The coker naphtha feedstock can contain from about 100 wppm to about 550 wppm nitrogen. The coker naphtha feedstock can contain from about 0.1 wppm to about 50 wppm silicon. Silicon within the coker naphtha feedstick can be in the form of silica ($SiO_2$) and/or an organosilicon compound, e.g., polydimethylsiloxane (PDMS).

As used herein, the term "about" or "approximately" means within an acceptable error range for the particular value as determined by one of ordinary skill in the art, which will depend in part on how the value is measured or determined, i.e., the limitations of the measurement system. For example, "about" can mean a range of up to 20%, up to 10%, up to 5%, and or up to 1% of a given value.

In certain embodiments, the coker naphtha feedstock has a boiling range from about 10° C. to about 300° C., from about 10° C. to about 220° C., from about 10° C. to about 140° C., from about 15° C. to about 100° C., or from about 25° C. to about 85° C.

In certain embodiments, particulates can be removed from the coker naphtha feedstock in the silica removal unit to produce a first effluent. For example, particulates can be removed by adsorption, filtration, and/or membrane separation. Non-limiting examples of separation processes that can be used in the disclosed subject matter are provided in U.S. Pat. Nos. 4,176,047 and 4,645,587, which are hereby incorporated by reference in their entireties. In certain embodiments, it is desirable to remove particulates from the coker naphtha feedstock prior to the hydrogenation unit, reactor, and/or toluene conversion unit to reduce catalyst deactivation by contaminants, e.g., silica, in the coker naphtha feedstock.

The method 100 can further include feeding the first effluent and a first hydrogen feed to a hydrogenation unit to produce a second effluent, e.g., via hydrotreating 102. In certain embodiments, the first effluent includes no silica. The hydrogen in the first hydrogen feed of the presently disclosed method can originate from various sources, including gaseous streams from other chemical processes, e.g., ethane cracking, methanol synthesis, or conversion of $C_4$ hydrocarbons to aromatics. The amount of hydrogen in the first hydrogen feed can be greater than about 70%, greater than about 80%, greater than about 85%, greater than about 90%, greater than about 95%, or greater than about 99%.

In certain embodiments, the method includes contacting the first effluent with a first hydrogen feed to selectively hydrogenate diolefins and acetylenes in first effluent to produce primary olefins. Non-limiting examples of processes that can be used in the disclosed subject matter to hydrogenate diolefins and acetylenes are provided in U.S. Patent Publication Nos. 2012/0273394 and 2005/0014639, European Patent Publication No. EP1188811, International Patent Publication No. WO2006/088539, and Breivik and Egebjerg, "Coker naphtha hydrotreating," Petroleum Technology Quarterly Q1 2008, which are hereby incorporated by reference in their entireties.

In certain embodiments, the method further includes partially removing sulfur, e.g., via hydrodesulfurization. At least some sulfur in the first effluent can react with hydrogen in the first hydrogen feed to form hydrogen sulfide ($H_2S$). The sulfur in the first effluent can be a component of one or more larger molecules, e.g., mercaptans and/or aliphatic and cyclic sulfides and disulfides. In certain embodiments, at least 10%, at least 20%, at least 30%, at least 40%, or at least 50% of the sulfur in the first effluent reacts with hydrogen to form hydrogen sulfide.

In certain embodiments, the method further includes partially removing nitrogen from the first effluent, e.g., via denitrogenation. At least some nitrogen in the first effluent can react with hydrogen in the first hydrogen feed to form ammonia ($NH_3$). The nitrogen in the first effluent can be a component of one or more larger molecules, e.g., methylpyrrol and/or pyridine. In certain embodiments, at least 10%, at least 20%, at least 30%, at least 40%, or at least 50% of the sulfur in the first effluent reacts with hydrogen to form hydrogen sulfide. The method can further include stripping hydrogen sulfide and ammonia from the first effluent.

In certain embodiments, the hydrotreating, i.e., the hydrogenation, hydrosulfurization and denitrogenation reactions, is carried out in the presence of a catalyst. The catalyst can be any type known in the art to be suitable for hydrotreating naphtha. By way of example, and not limitation, the catalyst can include Group VI-B and Group VIII metals, such as Co, Mo, Ni, and W. In particular embodiments, the catalyst includes cobalt-molybdenum and/or nickel-molybdenum. The metal catalyst can be supported on an inorganic oxide, e.g., alumina, silica, silica-alumina, or zeolite.

It should be noted that although select embodiments according to the disclosed method include treating the coker naphtha feedstock to remove impurities, i.e., silica, particulates, sulfur and/or nitrogen, no pretreatment is required. In certain embodiments according to the disclosed subject matter, the method includes little or no pretreatment, such that impurities are at most only partially removed.

In certain embodiments, the second effluent includes olefins and paraffins. The second effluent can contain from about 10 wt-% to about 80 wt-% olefins and from about 20 wt-% to about 80 wt-% paraffins. The second effluent can include other components, such as naphthenes and/or aromatics. For example, the second effluent can include less than about 12 wt-% naphthenes and/or less than about 5 wt-% aromatics.

In certain embodiments, the method 100 further includes feeding the second effluent to a reactor to produce a third effluent, a fourth effluent, and a fifth effluent 103. The method can further include combining the second effluent with a recycle stream prior to feeding it to the reactor.

In certain embodiments, the coker naphtha within the reactor can be converted to olefins and aromatics. Non-limiting examples of processes that can be used in the disclosed subject matter to convert coker naphtha to olefins and aromatics are provided in U.S. Pat. Nos. 5,043,522 and 7,128,827, which are hereby incorporated by reference in their entireties. For example, the coker naphtha can be converted to olefins and aromatics by a cracking process. The temperature of the cracking process can range from about 500° C. to about 700° C. The partial pressure of coker naphtha provided to the reactor can be from about 1 psia to about 30 psia.

The third effluent can include aromatics, such as benzene, toluene, xylene, and/or $C_9$ and higher aromatics. The third effluent can further include other components, including naphthenes, paraffins (e.g., n-pentane, n-hexane, dimethylbutanes, dimethylpentanes, etc.) and/or olefins (e.g., 2,3-dimethyl-butenes, trans-3-hexene, trans-3-heptene, etc.). For example, the third effluent can contain less than about 10 wt-% olefins and less than about 2 wt-% naphthenes. The amount of aromatics in the third effluent can be greater than about 40 wt-%, greater than about 65 wt-%, greater than about 80 wt-%, or greater than about 85 wt-%. For example, the third effluent can contain from about 10 wt-% to about 70 wt-% benzene, from about 5 wt-% to about 40 wt-% toluene, from about 1 wt-% to about 25 wt-% xylene, and from about 8 wt-% to about 55 wt-% $C_9$ and higher aromatics, olefins, and paraffins.

The fourth effluent can include olefins, such as ethylene and/or propylene. The fourth effluent can further include other components, including propane. For example, the fourth effluent can contain less than about 15 wt-% propane. The amount of olefins in the fourth effluent can be greater than about 40 wt-%, greater than about 60 wt-%, greater than about 70 wt-%, greater than about 80 wt-%, or greater than about 90 wt-%. For example, the fourth effluent can contain from about 10 wt-% to about 80 wt-% ethylene and from about 20 wt-% to about 80 wt-% propylene.

The fifth effluent can include $C_4$ hydrocarbons, methane, liquefied petroleum gas and/or fuel gas. For example, the fifth effluent can contain from about 2 wt-% to about 14 wt-% methane. The fifth effluent can contain from about 1 wt-% to about 100 wt-% $C_4$ hydrocarbons, for example, from about 1 wt-% to about 9 wt-% isobutylene, from about 2 wt-% to about 14 wt-% n-butenes, from about 6 wt-% to about 37 wt-% isobutane, and/or from about 7 wt-% to about 40 wt-% n-butane. The fifth effluent can contain from about 0.5 wt-% to about 99 wt-% $C_5$ hydrocarbons, for example, from about 0.5 wt-% to about 2 wt-% cyclopentenes, from about 4 wt-% to about 18 wt-% isopentane, from about 7 wt-% to about 27 wt-% n-pentane, from about 5 wt-% to about 21 wt-% isoamylene, and/or from about 8 wt-% to about 31 wt-% n-pentene.

In certain embodiments, the method 100 further includes feeding the fourth effluent to an olefins separation unit to produce a propylene product stream, an ethylene product stream, and a sixth effluent 104. In particular embodiments, the method includes feeding the fourth effluent to an existing ethylene plant for olefins separation. The method can include feeding the fourth effluent to a reactor within the olefins separation unit to convert olefins to propylene and ethylene.

The amount of propylene in the propylene product stream can be greater than about 85 wt-%, greater than about 90 wt-%, greater than about 95 wt-%, or greater than about 99 wt-%. The amount of ethylene in the ethylene product stream can be greater than about 85 wt-%, greater than about 90 wt-%, greater than about 95 wt-%, or greater than about 99 wt-%.

The sixth effluent can include $C_4$ hydrocarbons, liquefied petroleum gas, and/or propane. For example, the sixth effluent can contain from about 5 wt-% to about 40 wt-% liquefied petroleum gas and from about 50 wt-% to about 95 wt-% propane. In certain embodiments, the method 100 can further include recycling the sixth effluent by combining it with the second effluent prior to feeding the second effluent to the reactor 105.

In certain embodiments, the method 100 further includes feeding the third effluent from the reactor to a benzene, toluene, and xylene extraction unit to produce a benzene product stream, a mixed-xylene product stream, a $C_9$+ aromatics product stream, and a seventh effluent 106. Benzene, toluene, and mixed-xylene can be separated from the third effluent in the benzene, toluene, and xylene extraction unit. The method can include combining the third effluent with a recycle stream prior to feeding it to the benzene, toluene, and xylene extraction unit. Non-limiting examples of processes that can be used in the disclosed subject matter to extract benzene, mixed-xylene, and $C_9$ and higher aromatics are provided in U.S. Pat. Nos. 6,565,742, 5,225,072, 7,563,358, 5,399,244, and 5,723,026, which are hereby incorporated by reference in their entireties.

For example, benzene, toluene, and mixed xylene extraction can be performed using a liquid-liquid extraction process (e.g., the UOP Sulfolane™ process, the Axens Sulfolane process, or the Lurgi Arosolvan process) or extractive distillation (e.g., the Axens dimethylformamide process, the Lurgi Distapex process, the Krupp Uhde Morphylane™ process, or the GT-BTX process (GTC Technology LLC)). In certain embodiments, the BTX liquid-liquid extraction process can be performed at a temperature from about 200° C. to about 350° C. and at a pressure from about 2 bar to about 10 bar. In certain embodiments, the extractive distillation process can be performed at a temperature from about 100° C. to about 250° C. and at a pressure from about 1 bar to about 2 atm.

Alternatively and/or additionally, the third effluent, obtained from the reactor, can also be subjected to extraction to produce a high purity benzene product stream. For example, and not by way of limitation, the high purity benzene product stream can include greater than about 90%, greater than about 91%, greater than about 92%, greater than about 93%, greater than about 94%, greater than about 95%, greater than about 96%, greater than about 97%, greater than about 98% or greater than about 99% benzene. In certain embodiments, extraction of benzene from other aromatics can utilize the differences in the boiling points of the aromatics, e.g., by solvent-based extraction, to yield a high purity benzene product stream. For example, and not by way of limitation, the third effluent can be processed within a divided-wall distillation column to simultaneously separate $C_6$ aromatics, e.g., benzene (which has a boiling point of about 81° C.), toluene (which has a boiling point of about boiling point 110° C.) and mixed xylene (which has a boiling point of about 134° C. to 138° C.) using the differences in their boiling points. In certain embodiments, the benzene fraction obtained from the extraction process can be subsequently treated with a mild hydrocracking process to convert any aliphatic $C_6$ hydrocarbons to benzene and obtain a benzene-rich stream.

The benzene product stream can include benzene, and may further include other components, such as olefins (e.g., isobutylene, n-butenes, pentadienes, isoamylene, n-pentenes, trans-3-hexene and/or methylcyclohexene) and $C_4$ to $C_8$ paraffins (e.g., isobutane, n-butane, isopentane, n-pentane, cyclopentane, cyclohexane, n-hexane, methylcyclohexane, n-heptane, 1,3-dimethyl cyclohexane and 2,3,3-trimethylpentane). The amount of benzene in the benzene product stream can be greater than about 65 wt-%, greater than about 80 wt-%, greater than about 90 wt-%, greater than about 95 wt-%, or greater than about 99 wt-%. The benzene product stream can contain less than about 2 wt-%, less than about 1 wt-%, or less than about 0.5 wt-% olefins.

The mixed-xylene product stream can include mixed isomers of xylene, such as orthoxylene, metaxylene and/or paraxylene. The amount of mixed-xylene in the mixed-xylene product stream can be greater than about 20 wt-%, greater than about 35 wt-%, greater than about 50 wt-%, or greater than about 60 wt-%.

The $C_9$+ aromatics product stream can include $C_9$ and higher aromatics. By way of example, and not limitation, the $C_9$+ aromatics product stream can include naphthalene, cumene, indane, propylbenzene, isobutylbenzene, mesitylene, cymene, and/or azulene. The amount of $C_9$ and higher aromatics in the $C_9$+ aromatics product stream can be greater than about 20 wt-%, greater than about 40 wt-%, greater than about 65 wt-%, or greater than about 85 wt-%. The $C_9$+ aromatics product stream can contain less than about 2 wt-%, less than about 1 wt-%, or less than about 0.5 wt-% lower aromatics, such as xylene.

The seventh effluent can include toluene. The seventh effluent can further include additional components, including olefins, naphthenes and/or other aromatics. The amount of toluene in the seventh effluent can be greater than about 60 wt-%, greater than about 70 wt-%, greater than about 75 wt-%, or greater than about 85 wt-%. The seventh effluent can contain less than about 15 wt-% olefins, less than about 7 wt-% naphthenes, and less than about 1 wt-% other aromatics.

In certain embodiments, the method 100 further includes feeding the seventh effluent and a second hydrogen feed to a toluene conversion unit to produce an eighth effluent and a ninth effluent 107. The amount of hydrogen in the second hydrogen feed can be greater than about 70%, greater than about 80%, greater than about 85%, greater than about 90%, greater than about 95% or greater than about 99%. The method can include the hydrodealkylation of toluene within the toluene conversion unit to produce an eighth effluent containing benzene. Non-limiting examples of processes that can be used for the hydrodealkylation of toluene in the disclosed subject matter are provided in U.S. Pat. Nos. 2,739,993, 3,390,200, 4,463,206, and 7,563,358, and U.S. Patent Publication No. 2013/0245351, which are hereby incorporated by reference in their entireties.

In certain embodiments, the method 100 further includes recycling the eighth effluent to the benzene, toluene, and xylene extraction unit by combining it with the third effluent 108. The eighth effluent can include benzene and/or mixed-xylene. The eighth effluent can also include unconverted toluene. The eighth effluent can include greater than about 60 wt-%, greater than about 70 wt-%, greater than about 80 wt-%, greater than about 85 wt-%, or greater than about 90 wt-% benzene. The eighth effluent can contain less than about 10 wt-% mixed-xylene and less than about 10 wt-% toluene.

In certain embodiments, the method 100 further includes recycling the ninth effluent to the reactor by combining it with the sixth effluent 109. The ninth effluent can include $C_4$ hydrocarbons and/or liquefied petroleum gas.

Alternate methods according to the presently disclosed subject matter can include feeding the third effluent containing aromatics to the toluene conversion unit 107 prior to the benzene, toluene, and xylene extraction unit 106. Further methods according to the presently disclosed subject matter can omit toluene conversion 107, and can produce a toluene product stream.

Figure 2:
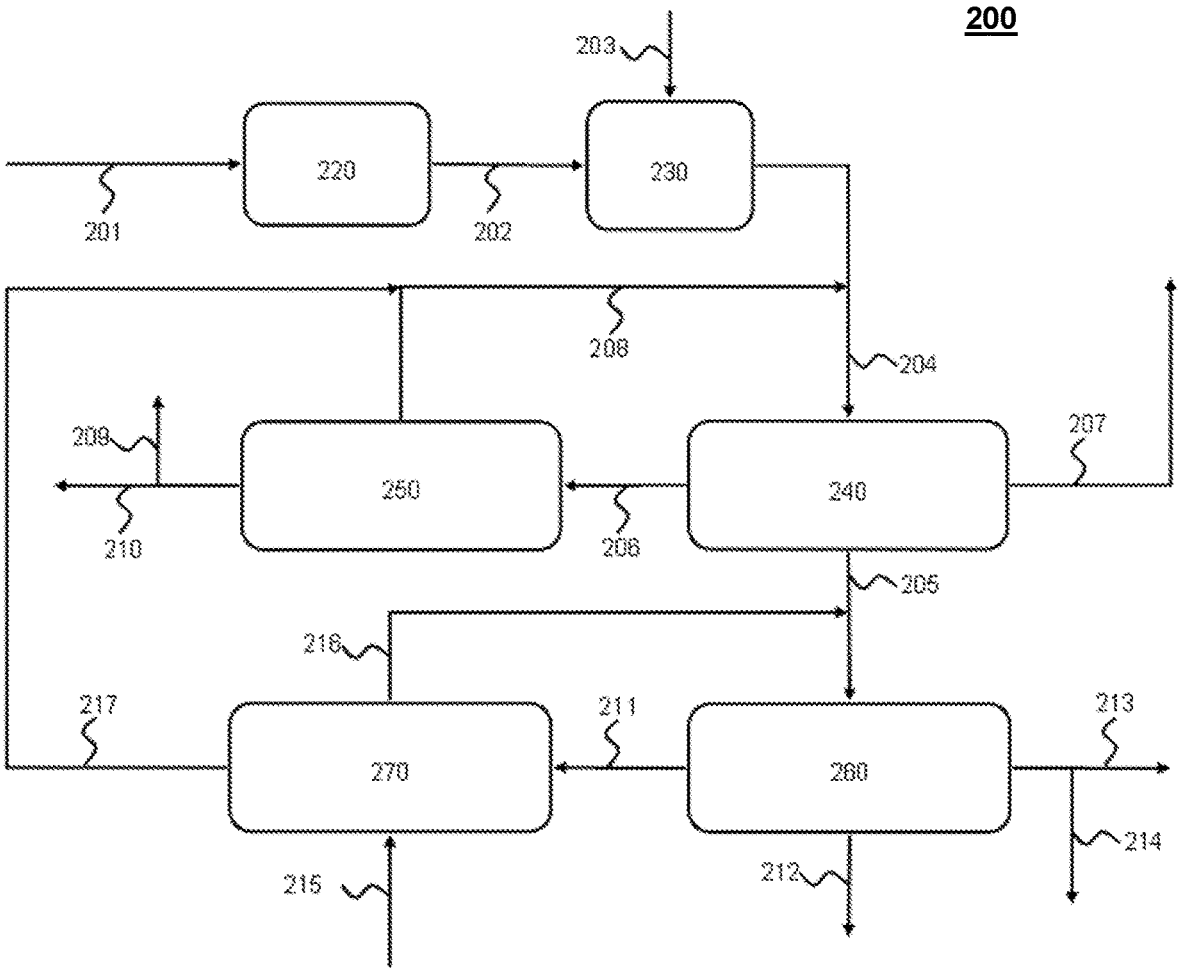
FIG. 2 depicts a system for producing olefins and aromatics from coker naphtha according to one exemplary embodiment of the disclosed subject matter.

The presently disclosed subject matter further provides systems for producing olefins, including propylene and ethylene, and aromatics, including benzene, toluene, and xylene, from coker naphtha. For the purpose of illustration and not limitation, FIG. 2 is a schematic representation of a system according to a non-limiting embodiment of the disclosed subject matter.

In certain embodiments, the system 200 can include a silica removal unit 220, a hydrogenation unit 230 coupled to the silica removal unit, an olefins and aromatics conversion unit 240 coupled to the hydrogenation unit, and an olefins separation unit 250 coupled to the olefins and aromatics conversion unit. The system can also include a naphtha feed line 201 coupled to the silica removal unit for transferring coker naphtha feedstock to the silica removal unit.

"Coupled" as used herein refers to the connection of a system component to another system component by any means known in the art. The type of coupling used to connect two or more system components can depend on the scale and operability of the system. For example, and not by way of limitation, coupling of two or more components of a system can include one or more joints, valves, transfer lines or sealing elements. Non-limiting examples of joints include threaded joints, soldered joints, welded joints, compression joints and mechanical joints. Non-limiting examples of fittings include coupling fittings, reducing coupling fittings, union fittings, tee fittings, cross fittings and flange fittings. Non-limiting examples of valves include gate valves, globe valves, ball valves, butterfly valves and check valves.

In certain embodiments, the silica removal unit 220 can include a bed of one or more catalysts. Catalysts for use in the presently disclosed system can be any catalyst suitable for the separation of silica from a coker naphtha feed. For example, the catalyst can include alumina and/or activated alumina. In particular embodiments, the catalyst is a spent alumina-based desulfurizer catalyst. In particular embodiments, the catalyst is a spent alumina-supported cobalt-molybdenum oxide catalyst.

The system 200 can further include a hydrogenation unit 230 coupled to the silica removal unit 220, e.g., via one or more transfer lines 202. One or more feed lines 203 can be coupled to the hydrogenation unit 230 for providing hydrogen to the hydrogenation reaction.

The hydrogenation unit can include one or more reactors. In certain embodiments, the hydrogenation unit can include a reactor, that can be any reactor type known to be suitable for the hydrogenation of diolefins. For example, but not by way of limitation, the reactor can be a fixed bed reactor. In certain embodiments, the hydrogenation unit 230 can include additional reactors. For example, the hydrogenation unit can include a fixed bed reactor for the hydrogenation of aromatics. Alternatively or additionally, the hydrogenation unit can include a fixed bed reactor for desulfurization, e.g., for hydrogenating mercaptans and aliphatic and cyclic sufides and disulfides to form hydrogen sulfide. Alternatively or additionally, the hydrogenation unit can include a fixed bed reactor for denitrogenation, e.g., for hydrogenating methylpyrrol and pyridine to form ammonia. One or more reactors in the hydrogenation unit can include a catalyst. For example, the catalyst can be a cobalt-molybdenum catalyst or a nickel-molybdenum catalyst.

In certain embodiments, the hydrogenation unit 230 can further include a cooler and coalescer for separating hydrogen rich gas from the effluent stream from the one or more reactors. The coalescer can be coupled to one or more compressors for compressing the hydrogen rich gas. The compressed hydrogen rich gas can be recycled to one or more of the reactors for hydrogenation, e.g., via a transfer line.

In certain embodiments, the hydrogenation unit 230 can further include a stripper for separating sulfur and nitrogen compounds, e.g., hydrogen sulfide and ammonia, from the coker naphtha stream. The stripper for use in the presently disclosed subject matter can be any type known in the art to be suitable for the stripping of gaseous sulfur and nitrogen compounds. It can be adapted to continuous or batch stripping. It can be coupled to one or more condensers and/or one or more reboilers. It can be a stage or packed column, and can include plates, trays and/or packing material.

In certain embodiments, the system 200 further includes an olefins and aromatics conversion unit 240 coupled to the hydrogenation unit 230, e.g., via one or more transfer lines 204. In certain embodiments, the olefins and aromatics conversion unit 240 is adapted to the catalytic cracking of coker naphtha. The olefins and aromatics conversion unit can include a reactor. The reactor for use in the olefins and aromatics conversion unit can be any reactor type suitable for the production of olefins and aromatics from a coker naphtha stream. For example, but not by way of limitation, such reactors include fixed bed catalytic reactors, such as tubular fixed bed catalytic reactors and multi-tubular fixed catalytic bed reactors, fluidized bed reactors, such as entrained fluidized bed catalytic reactors and fixed fluidized bed reactors, moving bed reactors, and slurry bed reactors such as three-phase slurry bubble columns and ebullated bed reactors. In certain embodiments, the reactor is a fluidized bed reactor. The dimensions and structure of the reactor can vary depending on the capacity of the reactor. The capacity of the reactor unit can be determined by the reaction rate, the stoichiometric quantities of the reactants and/or the feed flow rate. In certain embodiments, the space velocity of the reaction can range from about 50 $h^{-1}$ to about 500 $h^{-1}$.

The reactor can contain a catalyst. Non-limiting examples of suitable catalysts are provided in U.S. Pat. Nos. 5,091,163, 5,107,042 and 5,171,921 and European Patent Publication No. EP 0511013, which are hereby incorporated by reference in their entireties. In certain embodiments, the catalyst can include phosphorus-modified ZSM-5 catalyst with a surface Si/Al ratio of about 20 to about 60. In certain embodiments, the olefins and aromatics conversion unit can further include a stripper for removing hydrocarbon vapors from the spent catalyst and a regenerator for regenerating spent catalyst.

In certain embodiments, the olefins and aromatics conversion unit 240 can further include other components. For example, the olefins and aromatics conversion unit can include feed preheater, a regeneration air compressor, start-up heater, catalyst storage, make-up catalyst feed-lines, and systems for flue gas waste heat recovery and catalyst fines removal. The olefins and aromatics conversion unit can be integrated into an existing ethylene plant, e.g., by sharing a common product recovery section. Alternatively or additionally, the olefins and aromatics conversion unit can be coupled to the vapor recovery unit of a refinery for processing one or more of the reactor effluent streams 205, 206, 207.

In certain embodiments, the olefins and aromatics conversion unit 240 can be coupled to an olefins separation unit 250, e.g., via one or more transfer lines 206. The olefins separation unit can be integrated into an existing ethylene plant. The olefins separation unit can include one or more reactors and one or more regenerators. The reactor for use in the olefins separation unit can be any reactor type suitable for the conversion of alkanes to ethylene and/or propylene, for example, and not by way of limitation, fixed bed reactors, such as tubular fixed bed reactors and multi-tubular fixed bed reactors, fluidized bed reactors, such as entrained fluidized bed reactors and fixed fluidized bed reactors, moving bed reactors, and slurry bed reactors such as three-phase slurry bubble columns and ebullated bed reactors.

The olefins separation unit 250 can be coupled to one or more product lines 209, 210 for transferring product streams containing ethylene and/or propylene from the system. The olefins separation unit can be coupled to one or more recycle lines 208 for transferring unconverted alkanes and/or liquefied petroleum gas and/or $C_4$ hydrocarbons to the olefins and aromatics conversion unit 240.

In certain embodiments, the system 200 can further include a benzene, toluene, and xylene extraction unit 260 coupled to the olefins separation unit 250, e.g., via one or more transfer lines 205. The benzene, toluene, and xylene extraction unit can be coupled to one or more product lines 212, 213, 214 for transferring product streams containing benzene, mixed xylene, and/or $C_9$ and higher aromatics from the system.

The benzene, toluene, and xylene extraction unit of the presently disclosed system can include any equipment suitable for the separation of aromatics known in the art, for example, but not limitation, by a liquid-liquid extraction process or extractive distillation. The benzene, toluene, and xylene extraction unit can include one or more distillation units and/or one or more extractors and can be adapted for continuous or batch separation.

In certain embodiments, the system 200 can further include a toluene conversion unit 270 coupled to the benzene, toluene, and xylene extraction unit 260, e.g., via one or more transfer lines 211. The toluene conversion unit can include one or more reactors for the hydrodealkylation of toluene. The reactor for use in the toluene conversion unit of the presently disclosed system can be any type suitable for the hydrodealkylation of toluene, including, but not limited to, fixed bed reactors, such as tubular fixed bed reactors and multi-tubular fixed bed reactors, and fluidized bed reactors, such as fixed fluidized bed reactors.

The toluene conversion unit 270 can be coupled to one or more feed lines 215 for providing hydrogen to the hydrodealkylation reaction. The toluene conversion unit can be coupled to one or more recycle lines 216, 217. In certain embodiments, the toluene conversion unit can be coupled to a recycle line 216 for transferring benzene and/or xylene to the benzene, toluene, and xylene extraction unit 260. In certain embodiments, the toluene conversion unit can be coupled to a recycle line 217 for transferring olefins, liquefied petroleum gas, and/or $C_4$ hydrocarbons to the olefins and aromatics conversion unit 240.

The presently disclosed systems can further include additional components and accessories including, but not limited to, one or more gas exhaust lines, cyclones, product discharge lines, reaction zones, heating elements and one or more measurement accessories. The one or more measurement accessories can be any suitable measurement accessory known to one of ordinary skill in the art including, but not limited to, pH meters, flow monitors, pressure indicators, pressure transmitters, thermowells, temperature-indicating controllers, gas detectors, analyzers, and viscometers. The components and accessories can be placed at various locations within the system.

The methods and systems of the presently disclosed subject matter provide advantages over certain existing technologies. Exemplary advantages include improved production of olefins and aromatics from coker naphtha feedstock, reduced capital and equipment costs, and efficient integration of olefins and aromatics production into existing plants.

The following example is merely illustrative of the presently disclosed subject matter and should not be considered as a limitation in any way.

EXAMPLES

Example 1

This example describes the overall mass balance of the system according to one particular embodiment. Table 1 provides the mass flow rates and compositions of streams within the system according to one particular embodiment having the components described herein above with respect to FIG. 2.

TABLE 1

(Overall mass balance)

| | STREAM (FIG. 2) | | | | | | | | | | | | | | |
|---|---|---|---|---|---|---|---|---|---|---|---|---|---|---|---|
| | 201 | 202 | 204 | 207 | 206 | 210 | 209 | 208 | 205 | 211 | 212 | 213 | 214 | 216 | 217 |
| Mass Flow (tonnes/hr) | 90 | 90.1 | 97.6 | 11.2 | 64 | 19.3 | 37.8 | 8.6 | 22.5 | 10 | 4 | 11.6 | 4.5 | 7.7 | 1.74 |
| Weight % | | | | | | | | | | | | | | | |
| hydrogen | | | | | | 0.01 | | | | | | | | | |
| paraffins | 48.92 | 46.4 | 54.1 | | | | | | | | | | | | |
| olefins | 39.02 | 39.0 | 35 | | | | | | 6.5 | 10.3 | | 0.01 | | | |
| diolefins | 0.09 | 2.5 | | | | | | | | | | | | | |
| naphthenes | 0.099 | 9.9 | 9.1 | | | | | | 0.2 | 4.6 | | | | | |
| aromatics | 0.020 | 2.0 | 1.8 | | | | | | | | | | | | |
| methane | | | | 13.4 | | | | | | | | | | | |
| sulfur (kg/kg) | 0.002 | 0.2 | | | | | | | | | | | | | |
| nitrogen (ppm) | 300 ppm | | | | | | | | | | | | | | |
| silica (ppm) | 20 ppm | | | | | | | | | | | | | | |
| ethylene | | | | | 30.2 | 99.95 | | | | | | | | | |
| propylene | | | | | 59.1 | 0.03 | 99.6 | | | | | | | | |
| propane | | | | | 10.7 | | 0.4 | 79.7 | | | | | | | |
| LPG/$C_4$'s | | | | 86.4 | | | | 20.3 | | | | | | | 100 |
| benzene | | | | | | | | | 19.7 | 0.1 | | 99.9 | | 92.6 | |
| toluene | | | | | | | | | 37.4 | 85 | 0.6 | | | 2.5 | |
| mixed xylene | | | | | | | | | 16.2 | | 99.4 | | 0.02 | 4.9 | |
| $C_9$+ aromatics | | | | | | | | | 20 | | | | 99.8 | | |

In addition to the various embodiments depicted and claimed, the disclosed subject matter is also directed to other embodiments having other combinations of the features disclosed and claimed herein. As such, the particular features presented herein can be combined with each other in other manners within the scope of the disclosed subject matter such that the disclosed subject matter includes any suitable combination of the features disclosed herein. The foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

Various patents and patent applications are cited herein, the contents of which are hereby incorporated by reference herein in their entireties.

The invention claimed is:

1. A method for producing olefins and aromatics from a coker naphtha feedstock, the method comprising the steps of:

(a) removing silica from the coker naphtha feedstock to produce a first effluent;

(b) hydrogenating the first effluent to produce a second effluent;

(c) reacting the second effluent to produce a third effluent comprising aromatics, a fourth effluent comprising olefins, and a fifth effluent;

(d) separating the fourth effluent to produce a propylene product stream, an ethylene product stream, and a sixth effluent;

(e) recycling the sixth effluent by combining it with the second effluent;

(f) extracting benzene, toluene, and xylene from the third effluent to produce a benzene product stream, a mixed-xylene product stream, a C9+ aromatics product stream, and a seventh effluent;

(g) converting the toluene in the seventh effluent to produce an eighth effluent and a ninth effluent; and (h) recycling the eighth effluent by combining it with the third effluent.

2. The method of claim 1, wherein the removing comprises one or more of adsorption, filtration, or membrane separation.

3. The method of claim 1, wherein the removing comprises feeding the coker naphtha feedstock to a silica removal unit including a catalyst selected from one or more of alumina, activated alumina, spent alumina-based desulfurizer, or spent alumina-supported cobalt-molybdenum oxide.

4. The method of claim 1, wherein first effluent comprises silica-free coker naphtha.

5. The method of claim 1, wherein the second effluent comprises paraffins, olefins, naphthenes, and aromatics.

6. The method of claim 1, wherein the reacting comprises converting coker naphtha in the second effluent to olefins and/or aromatics.

7. The method of claim 1, wherein the fourth effluent comprises propylene, ethylene, and propane.

8. The method of claim 1, wherein the fifth effluent comprises $C_4$ hydrocarbons, $C_5$ hydrocarbons, fuel gas, and/or liquefied petroleum gas.

9. The method of claim 1, wherein the seventh effluent comprises toluene, olefins, and naphthenes.

10. The method of claim 1, wherein the converting comprises a hydrodealkylation reaction.

11. The method of claim 1, further comprising recycling the ninth effluent by combining it with the sixth effluent.

12. The method of claim 1, wherein the eighth effluent comprises benzene, xylene, and toluene.

13. A method for producing olefins and aromatics from a coker naphtha feedstock, the method comprising the steps of:

(a) removing silica from the coker naphtha feedstock to produce a first effluent;

(b) hydrogenating the first effluent to produce a second effluent;

(c) reacting the second effluent to produce a third effluent comprising aromatics, a fourth effluent comprising olefins, and a fifth effluent;

(d) separating the fourth effluent to produce a propylene product stream, an ethylene product stream, and a sixth effluent; and (e) recycling the sixth effluent by combining it with the second effluent, wherein the sixth effluent comprises butane, liquefied petroleum gas, and propane.

14. The method of claim 13, wherein the third effluent comprises benzene, toluene, xylene, and $C_9$+ aromatics.

15. A method for producing olefins and aromatics from a coker naphtha feedstock, the method comprising the steps of:

(a) removing silica from the coker naphtha feedstock to produce a first effluent;

(b) hydrogenating the first effluent to produce a second effluent;

(c) reacting the second effluent to produce a third effluent comprising aromatics, a fourth effluent comprising olefins, and a fifth effluent;

(d) separating the fourth effluent to produce a propylene product stream, an ethylene product stream, and a sixth effluent;

(e) recycling the sixth effluent by combining it with the second effluent;

(f) extracting benzene, toluene, and xylene from the third effluent to produce a benzene product stream, a mixed-xylene product stream, a C9+ aromatics product stream, and a seventh effluent; and (g) converting the toluene in the seventh effluent to produce an eighth effluent and a ninth effluent, wherein the ninth effluent comprises naphthenes, olefins, liquefied petroleum gas, and propane.

* * * * *